United States Patent [19]

Kondo et al.

[11] 4,341,067

[45] Jul. 27, 1982

[54] BOBBIN HOLDING DEVICE IN A DOFFING APPARATUS

[75] Inventors: Kanetaka Kondo, Nagoya; Takayuki Morita, Kariya; Masashi Ushino, Hekinan, all of Japan

[73] Assignee: Kabushiki Kaisha Toyoda Jidoshokki Seisakusho, Kariya, Japan

[21] Appl. No.: 117,304

[22] Filed: Jan. 31, 1980

[30] Foreign Application Priority Data

Feb. 10, 1979 [JP] Japan ..... 54/16000[U]

[51] Int. Cl.[3] ..... D01H 9/02; B66C 1/46

[52] U.S. Cl. ..... 57/275; 294/87 R

[58] Field of Search ..... 57/266, 268, 274, 275; 294/63 R, 64 R, 87 R, 93, 86 R

[56] References Cited

U.S. PATENT DOCUMENTS

| | | | |
|---|---|---|---|
| 1,810,754 | 6/1931 | Buddecke | 57/275 |
| 3,059,405 | 10/1962 | Ingham, Jr. | 57/275 X |
| 3,367,098 | 2/1968 | Schulz | 57/275 |
| 3,462,934 | 8/1969 | Schulz et al. | 57/275 |
| 3,633,959 | 1/1972 | McCollough et al. | 57/275 X |
| 3,667,204 | 6/1972 | Burgermeister et al. | 57/275 |
| 3,808,788 | 5/1974 | Viglione | 57/275 |
| 4,036,001 | 7/1977 | Tamai et al. | 57/275 X |
| 4,120,526 | 10/1978 | Rohrer | 57/275 X |

FOREIGN PATENT DOCUMENTS 53-12825 4/1978 Japan .

*Primary Examiner*—John Petrakes

*Attorney, Agent, or Firm*—Wenderoth, Lind & Ponack

[57] ABSTRACT

A bobbin holding device for holding at least one bobbin includes a hollow body having a bobbin receiving opening and connected at a base portion thereof to a doffing bar of a bobbin doffing and donning apparatus, a bobbin holding member disposed in the body and movable radially relative to the bobbin receiving opening between a projected position and a retracted position, and a flexible diaphragm disposed in the body in fluid tight relation with respect to the bobbin holding member for applying a fluid pressure on the bobbin holding member to move the same into the projected position. The bobbin holding device further includes a block member disposed between the flexible diaphragm and the doffing bar, the block member being formed with a fluid passage(s) to supply a pressurized fluid to the diaphragm without passing it through the doffing bar.

6 Claims, 3 Drawing Figures

BOBBIN HOLDING DEVICE IN A DOFFING APPARATUS

BACKGROUND OF THE INVENTION

This invention relates to a bobbin doffing and donning apparatus applicable to spinning machines and, in particular, to bobbin holders employed in a bobbin doffing and donning apparatus for transferring bobbins between predetermined positions.

Generally, the doffing and donning apparatus, which may be stationary or movable along the side of the spinning machine, includes a doffing bar extending in parallel with the spinning machine and supporting a succession of bobbin holders thereon in equispaced relationship. Each bobbin holder comprises a hollow body or housing mounted on the doffing bar with a bobbin receiving opening vertically extending through the housing for receiving the bobbin, a stationary bobbin holding member disposed within the housing so as to oppose the bobbin receiving opening, and a movable bobbin holding member movable radially relative to the opening between a projected position and a retracted position. When fluid pressure is applied on the movable bobbin holding member, it is driven into the projected position and holds the bobbin in cooperation with the stationary bobbin holding member.

Such a bobbin holder is disclosed, for example, in Japanese published Utility Model Specification No. 53-12825, wherein a cover plate is attached through a flexible diaphragm to the base portion of the housing in fluid sealing relationship. In order to supply the fluid into each of the spaces between the cover plates and the respective diaphragms thereby to cause the corresponding movable bobbin holding members to be moved into their projected positions, a fluid hole opening into the corresponding space is provided in each cover plate and another fluid hole in fluid communication with such hole provided in the cover plate is also formed in the doffing bar. Moreover, a fluid pipe supplied with the fluid from a source of supply external to the doffing apparatus extends along the doffing bar and the fluid pipe is connected through connecting plugs to the fluid holes in the doffing bar. Thus, the pressurized fluid from the external source can be fed through the fluid pipe and the fluid holes provided in both the doffing bar and the cover plates into the spaces between the cover plates and the diaphragms, whereby the movable bobbin holding members are projected into their operative positions through the diaphragms by the pressurized fluid.

However, the doffing and donning apparatus employing these prior bobbin holders necessarily requires the forming of numerous sets of fluid holes in the doffing bar and the cover plates and to provide the doffing bar with numerous connecting plugs for the connection of the fluid pipe. This is disadvantageous in that additional time and labor is required to manufacture the doffing and donning apparatus. Also, in assembling the holders into the doffing and donning apparatus, each of the housings of the holders has to be accurately mounted on the doffing bar so as to permit each fluid hole in the cover plate to be in alignment with the corresponding fluid hole formed in the doffing bar. This assembling operation is apparently very troublesome.

Moreover, it has been proposed to form a doffing bar in the form of a duct to which a fluid pipe is connected through a single connecting plug to supply fluid into the duct. This arrangement can employ a simpler piping system than that disclosed in the above-discussed Japanese published Utility Model Specification No. 53-12825, since only a single connecting plug is required. However, since numerous fluid holes have to be formed in the duct at numerous positions corresponding to fluid holes provided in the respective cover plates of the holders, the aforementioned disadvantages of requiring the additional time and labor and the troublesome assembling operation remain. This arrangement also has disadvantages in requiring that the doffing bar be of a relatively large size and that there be a large capacity of a fluid supply source to be employed, because of the employment of the duct-like doffing bar. Furthermore, a wall of the duct to which each housing is attached by screws must be of a sufficient thickness so as not to allow the fluid present in the duct to leak out through the openings provided in the duct for the screws. This clearly results in a heavy doffing bar.

It is therefore a principal object of this invention to provide a bobbin holding device including at least one bobbin holder mounted on a doffing bar, which can remove all the disadvantages of the prior art.

SUMMARY OF THE INVENTION

With this object in view, this invention resides in a bobbin holding device including a hollow body having means for receiving a bobbin and connected at a base portion thereof to a doffing bar of a bobbin doffing and donning apparatus, means disposed in the hollow body and movable relative to the bobbin receiving means between a projected position and a retracted position for holding the bobbin, and flexible means disposed in the hollow body in fluid tight relation with respect to the bobbin holding means for applying a fluid pressure on the bobbin holding means to move the same into the projected position, characterized in that the bobbin holding device further includes means disposed between the fluid pressure applying means and the doffing bar for supplying a pressurized fluid from an external source to the fluid pressure applying means without passing it through the doffing bar. According to this arrangement, there is no necessity to form any fluid guide passage in the doffing bar and all the disadvantages of the prior art can be removed.

BRIEF DESCRIPTION OF THE DRAWINGS

This invention will become more readily apparent from the following description of a preferred embodiment shown, by way of example only, in the accompanying drawings, wherein.

DESCRIPTION OF THE PREFERRED EMBODIMENT

This invention is applicable to both stationary and movable doffing apparatuses. Reference is made to U.S. Pat. No. 4,036,001 and German Laid-Open Patent Specification No. 28 42 593, in which one example each of the stationary and movable doffing apparatuses are disclosed respectively.

Figure 1:
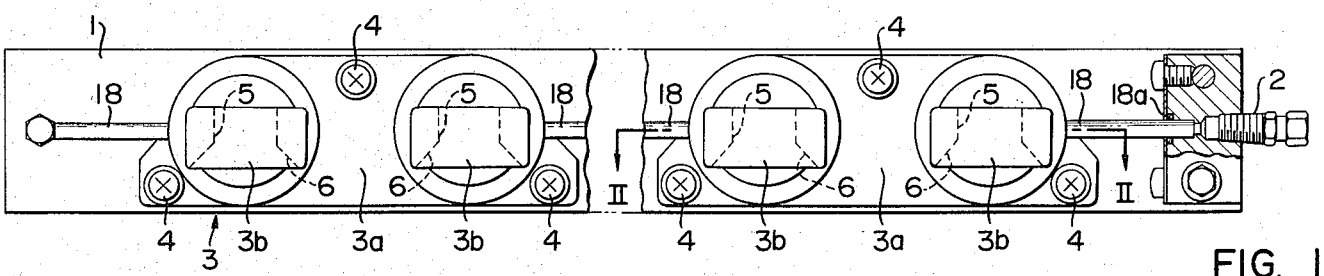
FIG. 1 is a front elevational view, partly in section, of a bobbin holding device consisting of a plurality of bobbin holders incorporating this invention thereinto, some of the bobbin holders being omitted for the purpose of simplification of illustration.
Figure 3:
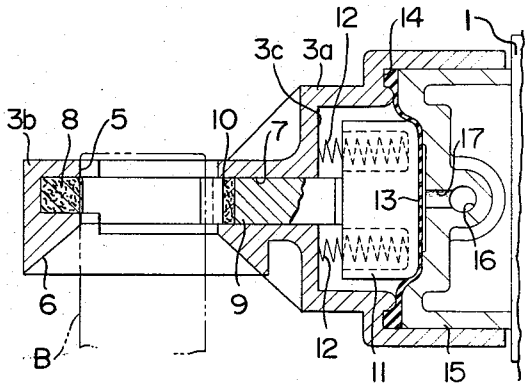
FIG. 3 is a cross-sectional view taken on the line III—III of FIG. 2.
Figure 2:
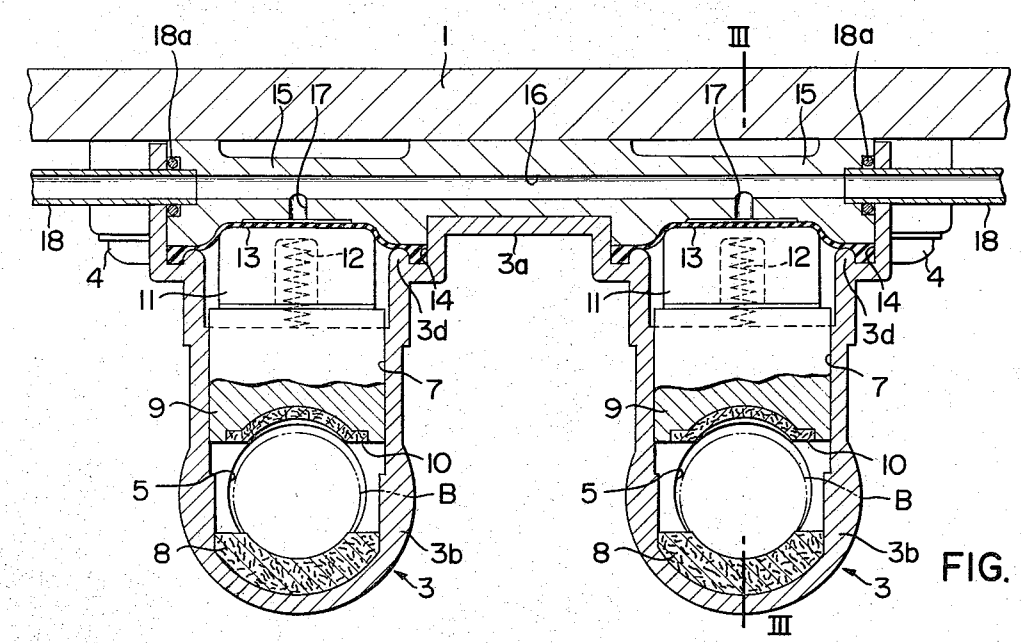
FIG. 2 is a sectional view, on an enlarged scale, through the bobbing holding device, taken on the line II—II of FIG. 1.

Referring now to FIGS. 1 to 3, there is shown a bobbin holding device associated with a doffing bar 1 of a bobbin doffing and donning apparatus. The bobbin holding device comprises a plurality of bobbin holders 3 mounted on the doffing bar 1 in equispaced relationship at the same intervals as spindles (not shown) arranged along the side of a spinning machine, along which the stationary doffing apparatus extends and the movable doffing apparatus travels. The doffing bar 1 can be moved vertically and inclined toward and away from the spindles by a not shown conventional mechanism of the doffing and donning apparatus so that the bobbin holders 3 mounted thereon can place the bobbins on the spindles and remove the bobbins therefrom.

Two adjacent bobbin holders 3 include one hollow body 3*a* in common, and the body 3*a* is mounted at the base portion thereof on the front side of the doffing bar 1 by a plurality of screws 4. Each body 3*a* has a pair of open ended, substantially cylindrical hollow portions 3*b*, in each of which a space or an access opening 5 for receiving therein a bobbin B is provided. The access opening 5 has a conical surface 6 extending downward from the circumferential lower edge of the access opening 5 to facilitate the insertion of the bobbin B into the access opening 5. The body 3*a* also has a pair of guide channels 7 each extending toward and opening into the respective access opening 5, a pair of fluid operated bobbin holding members or pistons 9 housed in the respective guide channels 7 so that each is moved radially outwardly and inwardly relative to the access opening 5 to restrict the diameter of the access opening 5, and means for normally biasing the movable holding members 9 in radially outwardly retracted positions. In the embodiment shown, the biasing means comprises springs 12 provided between a cup-like portion 11 of the holding member 9 and a wall 3*c* of the body 3*a*. Thus, the wall 3*c* acts as a spring seat and a stem portion of the holding member 9 extends through the wall 3*c*. In positions opposite to the movable holding members 9, stationary arcuate holding members 8 are provided. Since the stationary and movable holding members 8 and 9 have to hold the relatively heavy full bobbin B, the movable holding member 9 is provided with an arcuate friction member 10 providing a relatively large frictional resistance, and both the stationary holding member 8 and friction member 10 may be made of felt, leather, rubber or the like to assure the tight holding of the full bobbin.

Within the body 3*a*, a block member 15 is disposed to be positioned between the doffing bar 1 and the cup-like portions 11 of the movable holding members 9. The block member 15 may be fixed with respect to the doffing bar 1 by merely connecting the base portion of the body 3*a* to the doffing bar 1 by the screws 4 as described above. Disposed between each cup-like portion 11 and the block member 15 is a flexible diaphragm 13, of which a circumferential edge extends across an annular projection 3*d* of the body 3*a* provided around the cup-like portion 11 and extends into an annular groove 14. Thus, it is understood that the diaphragm 13 is disposed in fluid tight relationship with respect to the movable holding member 9.

A fluid passage 16 provided in the block member 15 extends in parallel with the doffing bar 1 through the overall length of the block member. The block members 15 are so arranged on the doffing bar 1 that the fluid passages 16 provided therein are in alignment with each other. The block member 15 also has a pair of fluid holes 17 each radially outwardly extending from the fluid passage 16 and opening into a space between the block member 15 and the respective diaphragm 13 to supply the space with pressurized fluid acting on the diaphragm 13. The adjacent fluid passages 16 are connected together by a connecting pipe 18 in a fluid tight manner as shown at 18*a* in FIG. 2. The endmost connecting pipe 18 is connected in a similar fluid tight manner to a connecting plug 2 which is in turn connected through suitable control means to a not shown source of fluid pressure, such as an air compressor, disposed separately from the spinning machine. All the afore-mentioned elements 2, 18 and 16 are in alignment with each other and in fluid communication with the external pressure source. Therefore, the fluid pressure can operate on the diaphragms 13.

In operation, in the event that the full bobbins B are to be removed from the not shown spindles of the spinning machine, the doffing and donning apparatus is operated so as to cause the bobbin holders 3 mounted on the doffing bar 1 to be placed immediately above the full bobbins B. Then, the doffing bar 1 is lowered to insert the upper ends of the full bobbins B into the corresponding access openings 5 in the bobbin holders 3. At that time, even if the axis of the access opening 5 is not in axial alignment with that of the associated full bobbin, the insertion of the full bobbin into the access opening 5 can be readily accomplished because the access opening 5 has a conical surface 6. Then, the not shown control means is operated to cause the pressurized fluid to be supplied from the fluid source through the fluid pipes 18, the fluid passages 16 and the fluid holes 17 into the spaces, where the fluid pressure is applied on the diaphragms 13 thereby to cause the movable holding members 9 to be moved radially inwardly into the projected positions against the action of the biasing means 12. Thus, the upper ends of the bobbins B can be firmly held between the stationary holding members 8 and the projected holding member 9.

The doffing bar 1 is raised with the full bobbins B held in the access openings 5 to remove the full bobbins B from the corresponding spindles and thereafter the doffing bar 1 is further moved to place the full bobbins B in a predetermined position. When the diaphragms 13 are released from the fluid pressure applied thereon, the movable bobbin holding members 9 are moved radially outwardly to the retracted positions by the action of the biasing means 12, thus releasing the full bobbins B from the corresponding bobbin holders 3.

It is understood from the foregoing that the present invention has provided an arrangement including the hollow body 3*a* having a base portion connected to the doffing bar 1 and placed over the block member 15 with the diaphragm 13 interposed therebetween, the block member 15 being formed with the fluid passage 16 extending through the overall length of the block member 15 and the fluid hole 17 extending from the fluid passage 16 toward the diaphragm 13 to apply the fluid pressure on the diaphragm 13. This arrangement does not require the forming of any fluid passage in the doffing bar, thus resulting in easy manufacturing of the doffing bar, easy mounting of the bobbin holder on the doffing bar, and easy piping for supplying the pressurized fluid to the bobbin holder. Furthermore, this arrangement makes it possible to minimize the overall size of the holding device, resulting in a light-weight holding device, without requiring a large capacity fluid pressure source.

While the present invention has been illustrated and described with reference to a single preferred embodiment thereof, it is to be understood that various changes in the details of construction and the arrangement and combination of parts may be resorted to without departing from the spirit and scope of the invention.

What we claim is:

1. A bobbin holding device for use in a bobbin doffing and donning apparatus, said device comprising:

an elongated doffing bar;

a hollow body having a base portion connected to said doffing bar and means for receiving a bobbin;

bobbin holding means positioned within said hollow body and movable relative to said bobbin receiving means between a projected position for holding a bobbin and a retracted position for releasing a bobbin;

flexible means, positioned within said hollow body in fluid tight relation with respect to said bobbin holding means, for moving said bobbin holding means from said retracted position thereof to said projected position thereof;

means for supplying pressurized fluid from an external source to said flexible means without passing said fluid through said doffing bar, and for thereby causing said flexible means to move said bobbin holding means to said projected position, said supplying means comprising a rigid block member having therein a fluid passage extending in a direction parallel to said doffing bar throughout the entire length of said block member, a space between said block member and said flexible means, and said block member having therein at least one hole extending between said fluid passage and said space.

2. A device as claimed in claim 1, wherein said block member has an elongated substantially rectangular configuration.

3. A device as claimed in claim 1, wherein said block member is snugly positioned in said base portion of said hollow body and is mounted on said doffing bar solely by connection of said base portion to said doffing bar.

4. A device as claimed in claim 1, wherein said bobbin receiving means comprises at least one opening extending vertically through said hollow body, said bobbin holding means comprises at least one piston movable substantially radially with respect to said opening, and said flexible means comprises at least one flexible diaphragm in contact with said piston.

5. A device as claimed in claim 1, wherein said bobbin receiving means comprises a plurality of openings extending vertically through said hollow body, said bobbin holding means comprises a plurality of pistons movable substantially radially with respect to a respective said opening, and said flexible means comprises a plurality of flexible diaphragms in contact with respective said pistons.

6. A device as claimed in claim 1, further comprising fluid pipes connected to opposite ends of said fluid passage and extending in axial alignment therewith.

* * * * *